US008172613B1

(12) United States Patent
Chen et al.

(10) Patent No.: US 8,172,613 B1
(45) Date of Patent: May 8, 2012

(54) COAXIAL CABLE END CONNECTOR

(75) Inventors: Li-Sen Chen, Taoyuan Hsien (TW); Yen-Jang Liao, Taoyuan Hsien (TW); Ken Hsieh, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 13/155,067

(22) Filed: Jun. 7, 2011

(30) Foreign Application Priority Data

Oct. 14, 2010 (TW) ..... 99219902 U

(51) Int. Cl.
*H01R 9/05* (2006.01)

(52) U.S. Cl. ..... 439/582; 439/63

(58) Field of Classification Search ..... 439/63, 439/578, 581, 582, 585, 944
See application file for complete search history.

(56) References Cited

U.S. PATENT DOCUMENTS 5,879,190 A * 3/1999 Maruyama et al. ..... 439/582
6,508,668 B1 1/2003 Yamane
7,367,840 B2 * 5/2008 Chen et al. ..... 439/581
7,704,096 B2 * 4/2010 Liao et al. ..... 439/582
7,874,870 B1 * 1/2011 Chen ..... 439/582
7,938,681 B2 * 5/2011 Lee et al. ..... 439/582

* cited by examiner

*Primary Examiner* — Thanh Tam Le
(74) *Attorney, Agent, or Firm* — McDermott Will & Emery LLP

(57) ABSTRACT

The present invention relates to a coaxial cable end connector, which includes an insulating housing, a signal terminal, and a shielding housing. The insulating housing includes a hollow hole, a terminal cavity, and an insulating plate. The signal terminal is disposed in the terminal cavity. The signal terminal includes a flat portion, wherein the flat portion of the signal terminal is electrically connected with an end of an internal conductive wire of the coaxial cable. A through hole is formed on a central region of the flat portion of the signal terminal, and two limiting pillars is disposed around an edge of the through hole of the signal terminal for positioning the internal conductive wire of the coaxial cable. The shielding housing includes a circular portion and a cover, wherein the circular portion of the shielding housing surrounds the insulating housing.

2 Claims, 8 Drawing Sheets

COAXIAL CABLE END CONNECTOR

RELATED APPLICATIONS

This application claims priority to Taiwan Application Serial Number 099219902, filed Oct. 14, 2010, which is herein incorporated by reference.

BACKGROUND

1. Technical Field

The present invention relates to a coaxial cable end connector, more particular to a coaxial cable end connector for being connected with an end of a coaxial cable having a small diameter.

2. Description of Related Art

Antennas disposed in electric devices for high frequency wireless communication are generally positioned outside of printed circuit boards in order to reduce the influence of high frequency electric components disposed on printed circuit boards on wireless high frequency signals emitted from antennas, so as to avoid properties of antenna radio frequency becoming unstable due to operation of electric components disposed on printed circuit boards. Coaxial cables are typically used as signal communication media for communicating electrical signals between antennas and printed circuit boards. In addition, an external diameter of the coaxial cable, volume of an end of the coaxial cable, and volume of a connector corresponding to a printed circuit board are requested for being minimized in limited space of an electric device.

As shown in FIG. 8, in prior art related to a coaxial cable end connector for being connected with an end of a coaxial cable having a small diameter, a design of a typical coaxial cable end connector A for being connected with a coaxial cable B having a small diameter is disclosed in U.S. Pat. No. 6,508,668. The coaxial cable end connector A of prior art includes an insulating housing A1, a signal terminal A2, and a shielding housing A3. The insulating housing A1 includes a first surface A11, and a second surface A12 opposite to the first surface A11. The first surface A11 of the insulating housing A1 faces a corresponding connector (not shown). A central region of the second surface A12 of the insulating housing A1 includes a hollow hole A121, a terminal cavity A122, and an insulating plate A123. The hollow hole A121 of the insulating housing A1 is formed penetrating the first surface A11 and the second surface A12 of the insulating housing A1. The terminal cavity A122 of the insulating housing A1 is communicated with the hollow hole A121. The signal terminal A2 is disposed in the terminal cavity A122 of the second surface A12 of the insulating housing A1. The signal terminal A2 included a flat portion A21. Two opposite end walls A22 are formed by bending in a direction from two opposite ends of the signal terminal A2 toward a backside of the first surface A11 of the insulating housing A1 respectively. A couple of contacting arms A23 are disposed in a direction from edges of the signal terminal A2 without the end wall A22 toward the first surface A11 of the insulating housing A1 respectively. A concave A221 is defined between two adjacent end walls A22 of the signal terminal A2 for accommodating an internal conductive wire B1 of the coaxial cable B, so that the conductive wire B1 of the coaxial cable B can be soldered with the flat portion A21 of the signal terminal A2, and the couple of the contacting arms A23 of the signal terminal A2 are used for communicating electrical signals with a corresponding connector (not shown). The shielding housing A3 includes a circular portion A31 and a cover A32, wherein the circular portion A31 of the shielding housing A3 surrounds the insulating housing A1, and the cover A32 of the shielding housing A3 presses the insulating plate A123 of the insulating housing A1 against the signal terminal A2 and the cover A32 of the shielding housing A3. The cover A32 of the shielding housing A3 includes a front fastener A321 and a back fastener A322 extended from the cover A32. The front fastener A321 and the back fastener A322 of the shielding housing A3 fasten a metallic shield B3 (metal wire mesh) and an external insulating layer B4 of the coaxial cable B respectively.

The general coaxial cable B suitable for prior art is a four-layer structure. The internal conductive wire B1, an internal insulating layer B2, the metallic shield B3, and the external insulating layer B4 are arranged from a center to an external surface of the coaxial cable B sequentially. The internal conductive wire B1 of the coaxial cable B is soldered with the flat portion A21 of the signal terminal A2 of the connector A, and the metallic shield B3 and the external insulating layer B4 of the coaxial cable B are fastened by the shielding housing A3 of the connector A respectively. Therefore the connector A is combined with an end of the coaxial cable B firmly.

The coaxial cable end connector A is connected with an end of the coaxial cable B, and volume of the coaxial cable end connector A is very small, therefore when the coaxial cable end connector A is plugged in a corresponding connector or removed form a corresponding connector in production line, operators usually take some wrong actions to plug or remove the coaxial cable end connector A, such as pulling and dragging the coaxial cable B. Such actions in production line may cause a separation between a soldered portion of an end of the internal conductive wire B1 of the coaxial cable B and the flat portion A21 of the signal terminal A2 of the connector A, so that the internal conductive wire B1 of the coaxial cable B would have poor contact with the flat portion A21 of the signal terminal A2 of the connector A. However, users cannot observe the contact status mentioned above in accordance with an appearance of the conventional connector A, thereby needing to change the coaxial cable B and coaxial cable end connector A thereof simultaneously, so as to cause unnecessary consumption of resources. Thus the conventional coaxial cable end connector A of prior art has to be modified.

SUMMARY

A coaxial cable end connector is provided. A combination status of a connector and a coaxial cable of the coaxial cable end connector can be observed by an appearance of the connector, more particular to a combination status of a signal terminal of a connector and an internal conductive wire of a coaxial cable.

In an aspect of the present invention is a connector for being connected with an end of a coaxial cable having a small diameter. The connector includes an insulating housing, a signal terminal, and a shielding housing. The insulating housing includes a first surface and a second surface opposite to the first surface. The insulating housing further includes a hollow hole, wherein the hollow hole is formed penetrating the first surface and the second surface of the insulating housing. The second surface of the insulating housing includes a terminal cavity and an insulating plate, wherein the terminal cavity of the insulating housing is communicated with the hollow hole. The signal terminal includes a flat portion. Two contacting arms are extended from the flat portion of the signal terminal toward the first surface of the insulating housing. A through hole is formed on a central region of the flat portion of the signal terminal. Two limiting pillars are disposed around an edge of the through hole of the signal terminal for positioning an internal conductive wire of the coaxial cable. The flat portion of the signal terminal is fixed to an end of the internal conductive wire of the coaxial cable. The shielding housing includes a circular portion and a cover, wherein the circular portion of the shielding housing surrounds the insulating housing, and the cover of the shielding housing presses the insulating plate of the insulating housing against the signal terminal and the cover of the shielding housing.

BRIEF DESCRIPTION OF THE DRAWINGS

FIGS. 6-1 is a cross-sectional view taken along line A-A shown in FIG. 6.

FIGS. 7-1 is a cross-sectional view taken along line B-B shown in FIG. 7.

DESCRIPTION OF THE PREFERRED EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
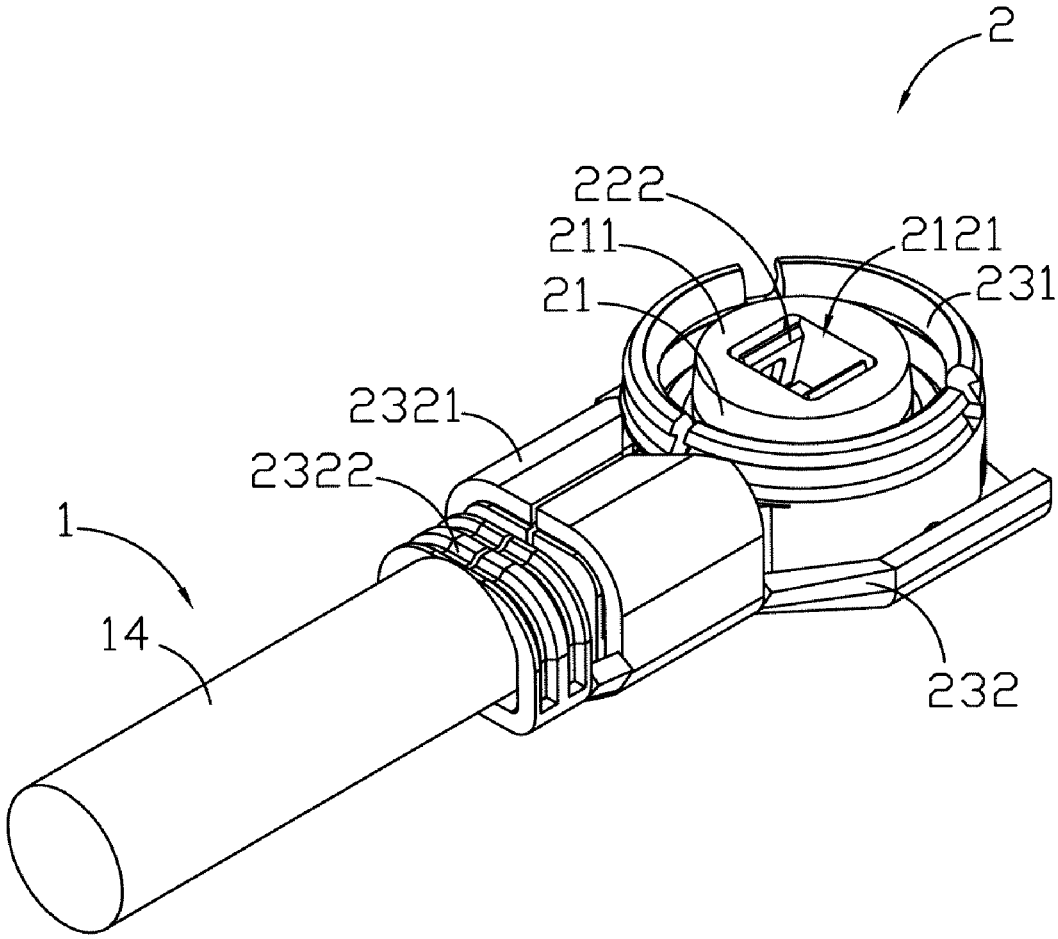
FIG. 1 is a perspective view of a combination of a coaxial cable end connector and a coaxial cable of an embodiment of the present invention.
Figure 2:
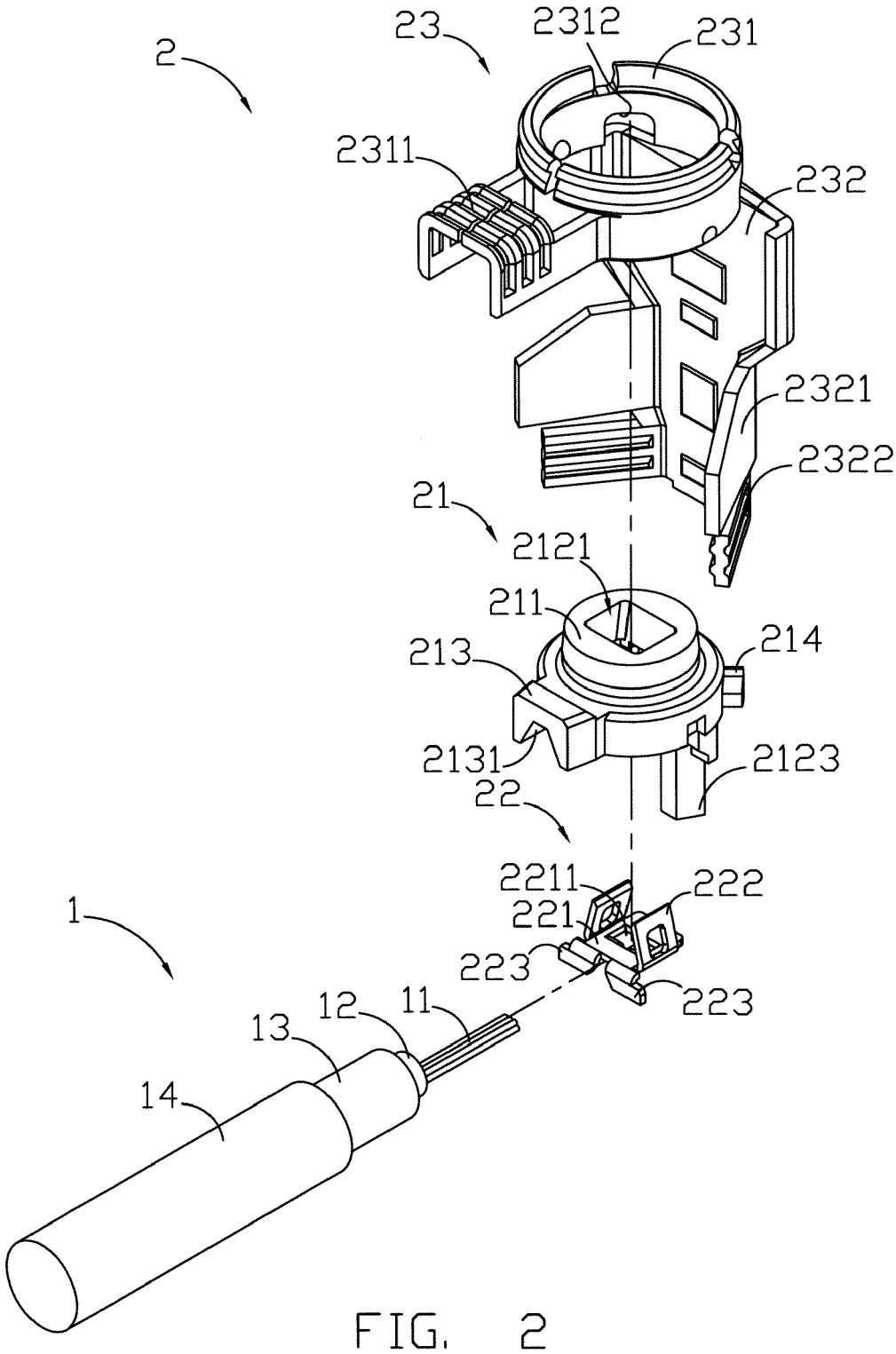
FIG. 2 is a perspective exploded view shown in FIG. 1.
Figure 3:
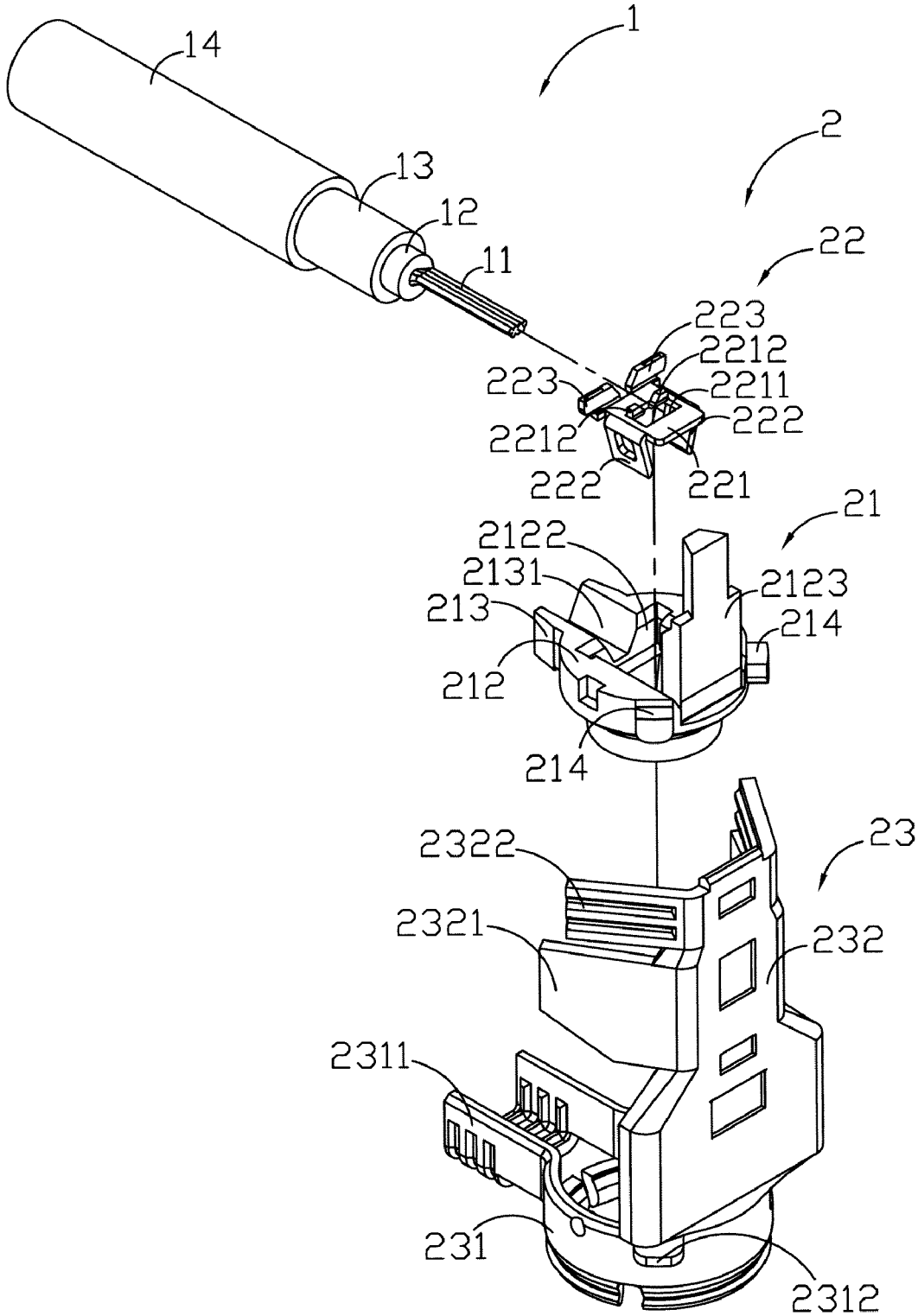
FIG. 3 is an exploded diagram viewed from bottom in FIG. 2.
Figure 4:
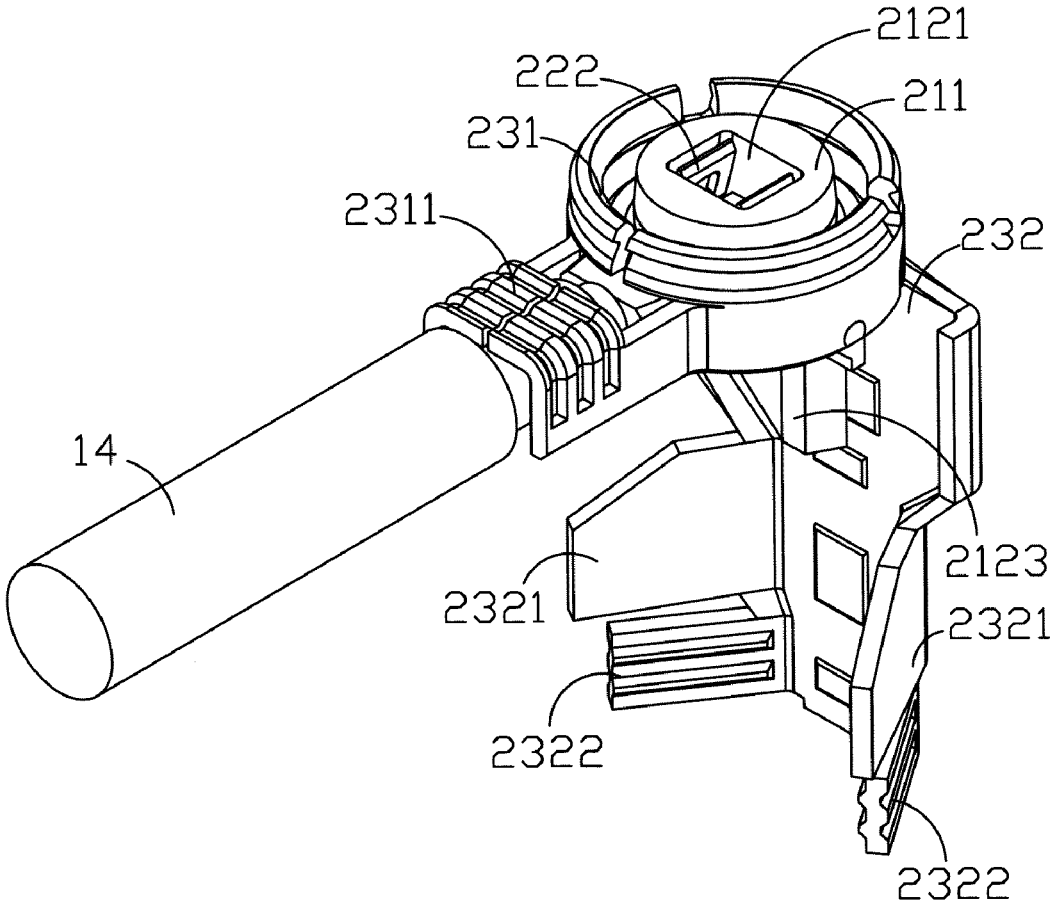
FIG. 4 is a schematic view of a combination shown in FIG. 1.
Figure 5:
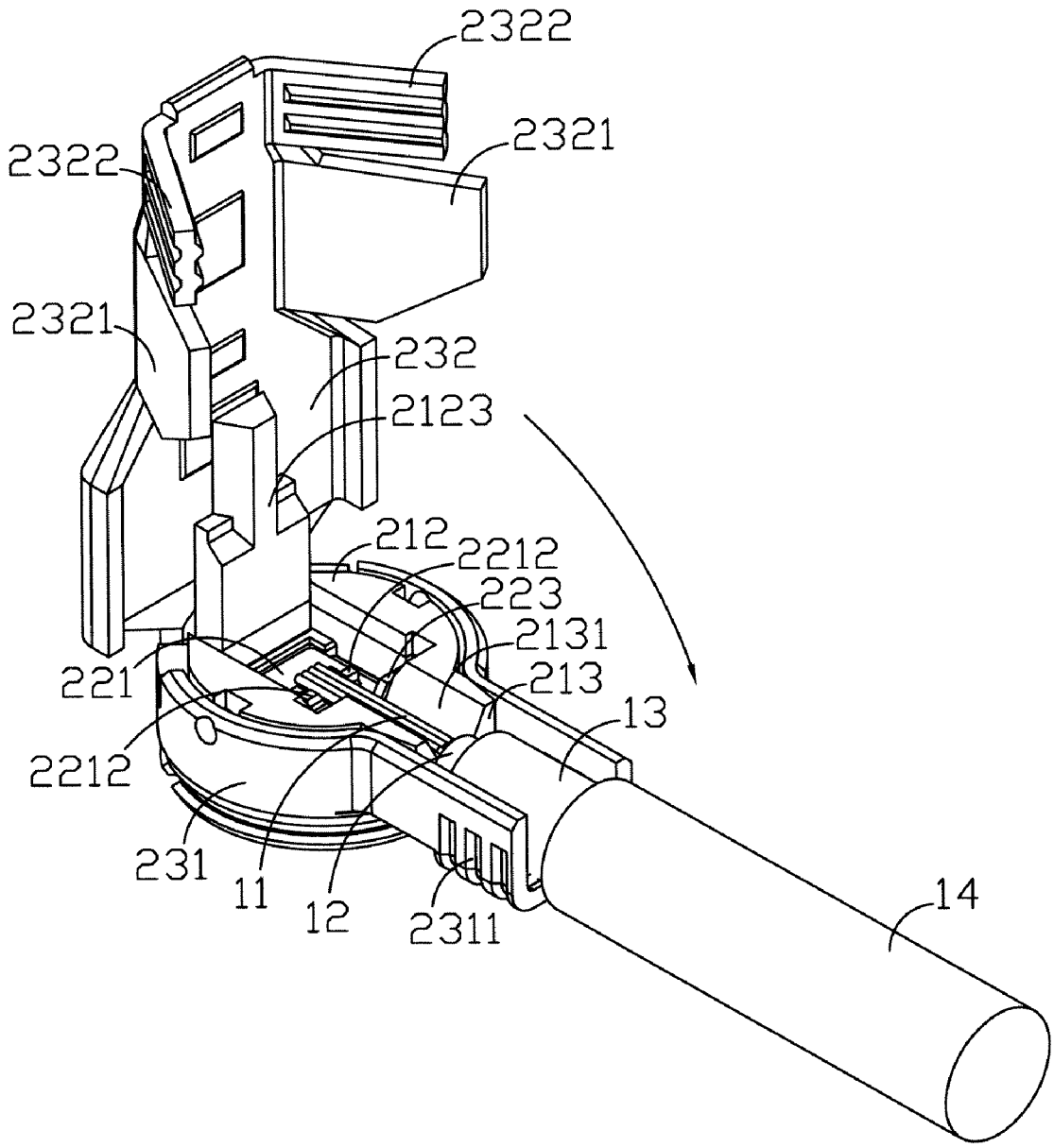
FIG. 5 is another perspective view shown in FIG. 4.
Figure 8:
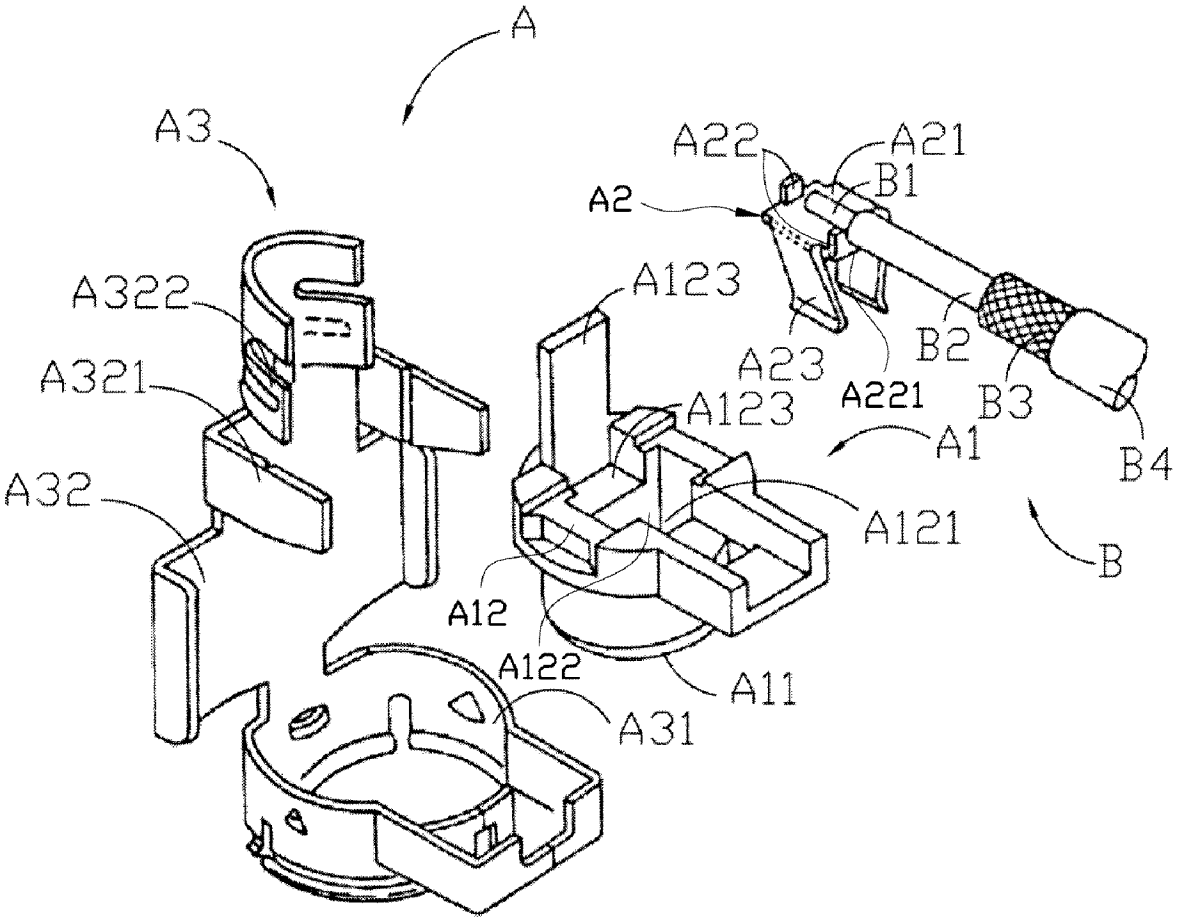
FIG. 8 (PRIOR ART)
FIG. 8 is a perspective exploded view of a coaxial cable end connector with a coaxial cable of prior art.

As shown in FIG. 1 to FIG. 3, a coaxial cable end connector 2 suitable for being connected with an end of a coaxial cable 1 is provided. The coaxial cable 1 is a four-layer structure, wherein the coaxial cable 1 includes an internal conductive wire 11, an internal insulating layer 12, a metallic shield 13, and an external insulating layer 14. In FIG. 1 to FIG. 3, the internal conductive wire 11 of the coaxial cable 1 is a new type multi-wire structure (seven wires). Although an appearance of the internal conductive wire 11 of the coaxial cable 1 is different from a conventional single wire structure B (shown in FIG. 8), the whole structure and functions of the coaxial cable 1 are still the same as a conventional coaxial cable B.

The coaxial cable end connector 2 mainly includes an insulating housing 21, a signal terminal 22, and a shielding housing 23. The insulating housing 21 is made of a material with poor conductance for insulating electrical signals communicated by the signal terminal 22 and the shielding housing 23. The insulating housing 21 is approximately a cylinder structure. The insulating housing 21 includes a couple of plane surfaces that are opposite to each other, wherein one of the plane surfaces is a first surface 211, and the other is a second surface 212. A hollow hole 2121 is formed between the first surface 211 and the second surface 212 of the insulating housing 21, and the hollow hole 2121 of the insulating housing 21 penetrates the first surface 211 and the second surface 212 of the insulating housing 21. A terminal cavity 2122 is formed on the second surface 212 of the insulating housing 21, wherein the terminal cavity 2122 of the insulating housing 21 is communicated with the hollow hole 2121, so that the signal terminal 22 of the connector 2 can be disposed in the terminal cavity 2122 of the insulating housing 21. An insulating plate 2123 is disposed on the second surface 212 of the insulating housing 21, wherein the insulating plate 2123 of the insulating housing 21 is a flexible suspension arm structure, therefore the insulating plate 2123 can be bent to deform toward the terminal cavity 2122 of the insulating housing 21.

As shown in FIG. 2 to FIG. 5, the signal terminal 22 of the connector 2 is made by stamping a metal flat board. The signal terminal 22 is utilized for communicating high frequency electrical signals of the coaxial cable 1. The signal terminal 22 includes a flat portion 221. Two contacting arms 222 are formed by bending two opposite edges of the flat portion 221 respectively, so that after the signal terminal 22 is disposed in the terminal cavity 2122 of the insulating housing 21, the two contacting arms 222 of the signal terminal 22 can be disposed in the hollow hole 2121 of the insulating housing 21. Namely, the two contacting arms 222 are extended from the terminal cavity 2122 (positioned on the second surface 212) of the insulating housing 21 toward the first surface 211 of the insulating housing 21. A through hole 2211 is formed on a central region of the flat portion 221 of the signal terminal 22. A material surrounding the through hole 2211 may be bent to form two limiting pillars 2212 for positioning the internal conductive wire 11 of the coaxial cable 1, so that the internal conductive wire 11 of the coaxial cable 1 is limited on a central region of the flat portion 221 of the signal terminal 22. In order to retain the signal terminal 22 firmly in the terminal cavity 2122 of the insulating housing 21, a couple of positioning boards 223 is extended from an end of the signal terminal 22. Size of the two positioning boards 223 of the signal terminal 22 is approximately bigger than the terminal cavity 2122 of the insulating housing 21. When the signal terminal 22 is assembled in the terminal cavity 2122 of the insulating housing 21, the two positioning boards 223 of the signal terminal 22 are coupled to the terminal cavity 2122 of the insulating housing 21, thereby the signal terminal 22 can be retained in the terminal cavity 2122 of the insulating housing 21.

The shielding housing 23 of the connector 2 is also made by stamping a metal flat board. The shielding housing 23 approximately surrounds the insulating housing 21 for providing the insulating housing 21 and the signal terminal 22 with good electromagnetic shielding protection. The shielding housing 23 includes a circular portion 231, wherein the circular portion 231 of the shielding housing 23 surrounds the insulating housing 21. The circular portion 231 of the shielding housing 23 is connected with a cover 232, thereby the cover 232 of the shielding housing 23 would press the insulating plate 2123 of the insulating housing 21 against the signal terminal 22 and the cover 232 of the shielding housing 23 to prevent the signal terminal 22 from being separated from the terminal cavity 2122 of insulating housing 21 and being contacted with the shielding housing 23 accidentally.

As shown in FIG. 2 and FIG. 3, an extending portion 213 is disposed additionally between the first surface 211 and the second surface 212 of the insulating housing 21. A cable cavity 2131 is formed on the extending portion 213 of the insulating housing 21. The cable cavity 2131 of the insulating housing 21 is communicated with the terminal cavity 2122 of the insulating housing 21, thereby the internal insulating layer 12 of the coaxial cable 1 can be disposed in the cable cavity 2131 of the insulating housing 21. As shown in FIG. 2, FIG.

Figure 6:
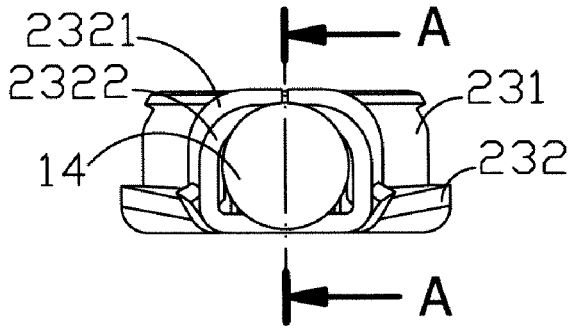
FIG. 6 is a front schematic view shown in FIG. 1.
Figures 1, 6:
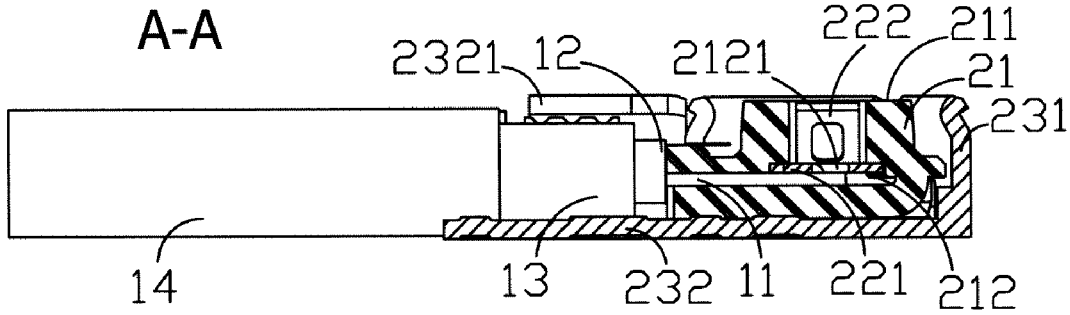
Figure 7:
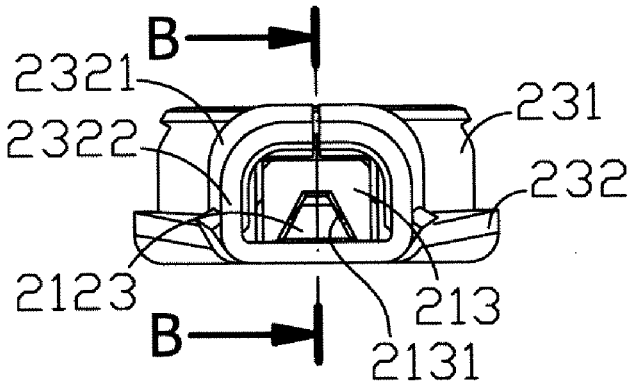
FIG. 7 is a front schematic view of a coaxial cable end connector without a coaxial cable shown in FIG. 6.
Figures 1, 7:
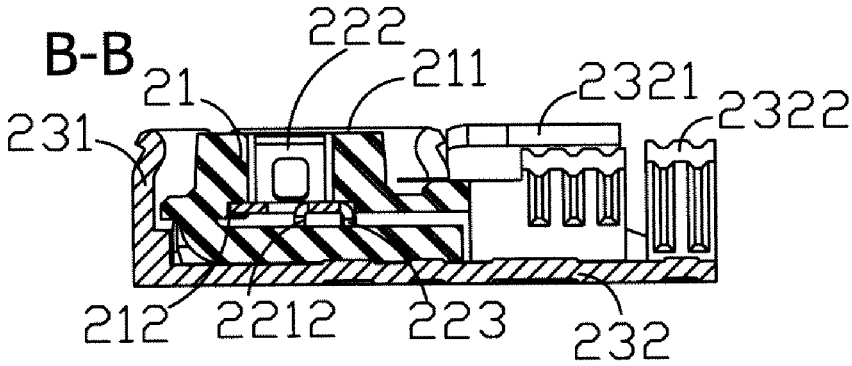

3, FIGS. 6-1, and FIGS. 7-1, because the extending portion 213 of the insulating housing 21 is extended outward from the insulating housing 21, in order to provide better electromagnetic shielding protection for the internal conductive wire 11 of the coaxial cable 1 and the signal terminal 22 of the connector 2, in an embodiment of the present invention, the circular portion 231 of the shielding housing 23 further includes a shielding cover 2311 extended from the circular portion 231, wherein the shielding cover 2311 of the shielding housing 23 surrounds the extending portion 213 of the insulating housing 21.

In the figures of the above mentioned, the cover 232 of the shielding housing 23 includes a front fastener 2321 and a back fastener 2322 extended from the cover 232 sequentially for fastening the coaxial cable 1 firmly. However, the back fastener 2322 is used for fastening the metallic shield 13 of the coaxial cable 1, and the front fastener 2321 is used for fastening the shielding cover 2311 of the circular portion 231 of the shielding housing 23, thereby pressing the internal conductive wire 11 of the coaxial cable 1 close to the cable cavity 2131 of the extending portion 213 of the insulating housing 21. The electromagnetic shielding protection of the shielding housing 23 can be improved due to the front fastener 2321 of the shielding housing 23.

As shown in FIG. 1, FIG. 2, and FIG. 3, in order to enhance combination of the shielding housing 23 and the insulating housing 21, two concaves 2312 are formed at proper positions of the circular portion 231 of the shielding housing 23. Two protruding portions 214 are formed on the positions of the insulating housing 21 corresponding to the two concaves 2312 of the circular portion 231 of the shielding housing 23. Therefore the shielding housing 23 can be fixed to the insulating housing 21 by combination of the concave 2312 of the circular portion 231 of the shielding housing 23 and the protruding portion 214 of the insulating housing 21. So that relative sliding motion between the shielding housing 23 and the insulating housing 21 would be prevented.

The internal conductive wire 11 of the coaxial cable 1 is disposed between the two limiting pillars 2212 of the signal terminal 22, and the two limiting pillars 2212 of the signal terminal 22 shown in FIG. 3 are extended in a direction toward a backside of the first surface 211 of the insulating housing 21 respectively. However, when users observe the hollow hole 2121 of the insulating housing 21 from the first surface 211 of the insulating housing 21, users can still see whether the internal conductive wire 11 of the coaxial cable 1 is contacted with the signal terminal 22 or not by the through hole 2211 of the signal terminal 22. Therefore the disclosure of the present invention can overcome disadvantages of prior art.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A coaxial cable end connector for being connected with an end of a coaxial cable having a small diameter, the coaxial cable end connector comprising an insulating housing, a signal terminal, and a shielding housing, the insulating housing comprising a first surface, a second surface opposite to the first surface, and a hollow hole, the second surface of the insulating housing comprising a terminal cavity and an insulating plate, the terminal cavity of the insulating housing communicated with the hollow hole, the signal terminal disposed in the terminal cavity of the second surface of the insulating housing, the signal terminal comprising a flat portion electrically connected with an end of an internal conductive wire of the coaxial cable, and two contacting arms extended from the flat portion of the signal terminal toward the first surface of the insulating housing, the shielding housing comprising a circular portion and a cover, the circular portion of the shielding housing surrounding the insulating housing, the cover of the shielding housing pressing the insulating plate of the insulating housing against the signal terminal and the cover of shielding housing, wherein the coaxial cable end connector is characterized by a through hole formed on a central region of the flat portion of the signal terminal, and two limiting pillars disposed around an edge of the through hole of the signal terminal for positioning the internal conductive wire of the coaxial cable.

2. The coaxial cable end connector as claimed in claim 1, further comprising:

at least one positioning board bent from an end of the flat portion of the signal terminal, wherein the positioning board of the signal terminal is coupled to the terminal cavity of the insulating housing.

* * * * *